United States Patent [19]

Grünig et al.

[11] 4,347,679

[45] Sep. 7, 1982

[54] ELECTRIC RELEASE DEVICE FOR FIRE-ARMS

[75] Inventors: Kurt Grünig; Heinz Elmiger, both of Malters; Franz Schneider, Oberweningen, all of Switzerland

[73] Assignee: Feinwerkbau, Westinger & Alterburger GmbH & Co., Oberndorf, Fed. Rep. of Germany

[21] Appl. No.: 117,126

[22] Filed: Jan. 31, 1980

[30] Foreign Application Priority Data

Feb. 13, 1979 [CH] Switzerland ..... 1378/79

[51] Int. Cl.[3] ..... F41C 19/12

[52] U.S. Cl. ..... 42/84

[58] Field of Search ..... 42/84, 69 A, 69 R; 89/28 R, 28 A

[56] References Cited

U.S. PATENT DOCUMENTS

| | | | |
|---|---|---|---|
| 3,626,624 | 12/1971 | Green | 42/84 |
| 3,899,845 | 8/1975 | Wild et al. | 42/84 |
| 4,009,536 | 3/1977 | Wolff | 42/84 |

FOREIGN PATENT DOCUMENTS 2832506 2/1979 Fed. Rep. of Germany .

*Primary Examiner*—Charles T. Jordan

[57] ABSTRACT

In a battery-operated electric release device for fire-arms having an electronic switch 11 arranged in line between a first capacitor 8 and an electromagnet 9. The battery 3 is connected to the capacitor with no additional mechanically operated switch arranged therebetween. The electronic switch 11 is fired by discharge of a second capacitor 14 through a trigger controlled mechanical switch 15. The second capacitor 14 is provided with a voltage divider 12, 13 so that its charging time is greater than that of the first capacitor 8, whereby the fire arm cannot be prematurely discharged.

8 Claims, 3 Drawing Figures

ELECTRIC RELEASE DEVICE FOR FIRE-ARMS

Figure 1:
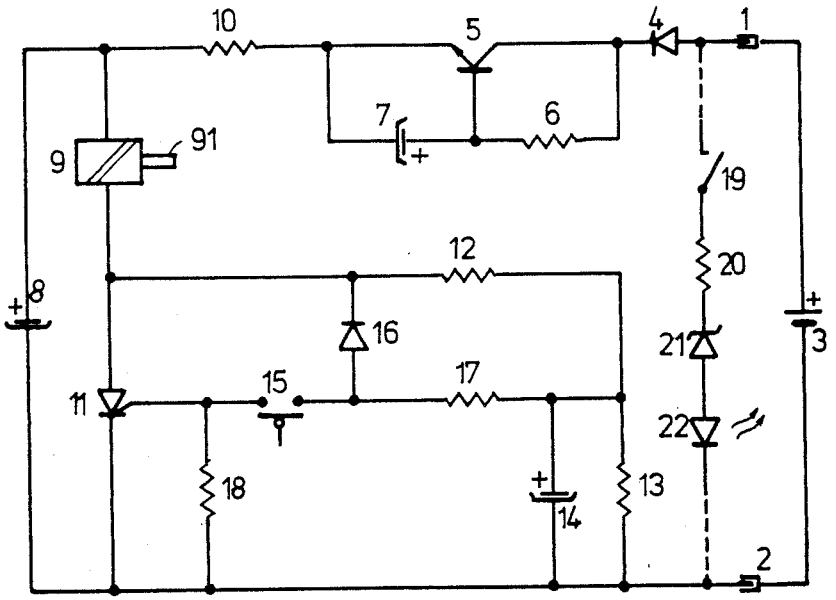

The present invention relates to an electric release device for fire-arms having a trigger-coupled mechanical switch closing the connection line between a capacitor and an electromagnet excited by the current supplied by the said capacitor, the latter being recharged by a battery.

A device of this type has been known already from German Laid-Open Patent Application No. 24 04 053. In this known device which comprises a d.c. converter charging the capacitor to a voltage higher than the battery voltage, the shooter is required before firing a shot to actuate a starter switch which renders the d.c. converter operative. This necessity, namely the operation of the switch after each shot in preparation of the next shot, exacts great attention on the shooter's part, and as a consequence it is easily possible in the case of this known device that as a result of the nervous strain normally associated with every competition the switch may not be operated in due time, which would entail disadvantages for the shooter in the competition. In this known device, the mechanical switch closes the connection line by rendering conductive a thyristor arranged in the connection line.

German Utility Model No. 77 27 498 discloses an electromechanical trigger device for competition arms, in which a special switch need not be operated before each individual shot, but in which the battery is connected to the electronic circuit by means of a switch which must be operated by the shooter only once, at the beginning of the competition, and which, so the publication says, may thereafter remain actuated for several hours, i.e. for the full duration of the competition. At the end of the competition, the switch is to be switched off. However, this known mode of action offers the risk that the shooter may either by error or induced by the erroneous consideration that the battery should be spared, open the switch during the competition and thereafter forget to close it again before the next shot.

The present invention has for its object to provide a release device of the type described above, which excludes any risk that the arm may fail to fire a shot because a switch has been operated incorrectly or not at all.

According to the invention, this problem is solved by an arrangement in which the battery is connected to the capacitor with no additional mechanically operated switch provided therebetween.

The "connection" between the battery and the capacitor may take the form either of a direct connection or of additional electronic means or else of a transformer coupling.

The advantage of the invention lies in the fact that as regards the properties and actuation functions ascertainable by the shooter, the design of the release device may be such that it can be used just like a mechanical release device, which means that once the arm has been loaded and cocked, firing is immediately possible, without the need to operate any switches. Only the battery or the battery set must be changed as necessary.

From German patent specification No. 15 53 868, an electronically controlled release device for small arms has been known which likewise does not require the shooter to take care of the operation of any special switches, because this arrangement includes a mechanical switch separating the battery from the remaining parts of the device, the arrangement of the said switch being such that it is automatically closed by the firing pin during the cocking operation and opened when the arm is uncocked. However, in this case the mechanical connection of the switch with the firing pin makes the manufacture of the arm or the subsequent attachment of the release device to an arm with mechanical release device more complicated and expensive.

In some cases, when the voltage charging the capacitor is constantly applied to the discharging circuit of the capacitor, difficulties may arise for instance during the firing operation, which means that undesirable vibrations or influences reducing the service life of the battery may occur during the discharge. Therefore, an electronic switch has been provided, in one embodiment of the invention, in the charging circuit and/or the discharging circuit of the capacitor. When arranged in the discharging circuit, such electronic switch may reduce or prevent such undesirable vibrations. In this case, the electronic switch may be provided at the same time in the charging circuit. If the electronic switch is provided in the discharging circuit only, and not in the charging circuit, this enables the d.c. path from the battery to the electromagnet to be blocked, which offers the additional advantage that in cases where in another embodiment of the type known from German Laid-Open patent application No. 24 04 053 the mechanical switch is not directly provided in the discharging circuit of the capacitor, but connected to the control electrode of another electronic switch arranged in the said circuit, the discharging of the said other electronic switch, for instance a thyristor, can be safely performed. This latter advantage is achieved even if the electronic switch is provided in the connection line between the battery and the discharging circuit of the capacitor, i.e. outside the discharging circuit. Thus, the battery can be separated from the discharging circuit by this electronic switch; the electronic switch must not necessarily be rendered conductive before or at the latest at the moment when the said other electronic switch is rendered conductive.

This makes the whole arrangement especially simple. The arrangement of this electronic switch outside the discharging circuit may also be convenient so as not to hinder the occurrence of a voltage reversal at the other electronic switch caused by the oscillating circuit formed by the capacitor and the electromagnet, which voltage reversal causes the said other electronic switch to be turned off.

In a further improvement of the two last-mentioned embodiments, the electronic switch is blocked for a short period of time at the end of the excitation of the electromagnet, which period of time may be a few milliseconds, for instance 3 to 10 milliseconds. When the electronic switch is arranged outside the discharging circuit, it need not be transferred to the blocked state exactly at the end of the excitation of the electromagnet, but may be in this state already at an earlier time; this is absolutely harmless when the capacitor is already completely charged. At the end of the said short period of time, the electronic switch becomes again conductive, thus enabling the capacitor to be charged.

In one embodiment of the invention, the design of the device is such that only little leakage current is encountered. The advantage of this embodiment lies in the fact that because of the reduced leakage current in the device, which may be approximately equal to the self-discharge current of the battery, the latter—though being directly connected to the device—will when the arm is out of use not be discharged much earlier than if the battery were not connected to the device, i.e. separated by a switch. Accordingly, the fact that there is no switch that would have to be especially operated by the shooter has no or only very little influence on the service life of the battery, and the batteries currently available on the market may safely maintain, for instance the triggering function, if changed once per year.

In one embodiment of the invention, the mechanical switch comprises a first contact and a second contact which latter takes the form of a leaf spring. In the inoperative condition, the two contacts are positioned directly adjacent each other. A pin coupled with the trigger can be pressed against the side of the leaf spring facing away from the first contact, and the side of the leaf spring facing the first contact is supported by insulating material arranged at a distance from the contact area of the pin. It results that when the contact is closed, the leaf spring is not moved as a whole against the first contact; rather, the leaf spring is resiliently deformed or buckled by the pin in its area of impact, whereby the switch is caused to close. This makes it possible that on the one hand the short displacement of the pin to close the switch can be easily achieved, while on the other hand the switch is highly proof against unwanted closing, for instance as a result of shocks or vibrations. Moreover, the force necessary for closing the switch may be influenced by the elastic properties of the leaf spring and the manner in which the leaf spring is supported. It may be advantageous to give the end of the pin which is in contact with the leaf spring a rounded shape and to keep the radius of curvature of the pin smaller than that of the deformation produced by the pin in the leaf spring.

In a further improvement of the embodiment just described, the first and the second contacts have arranged between them a ring made of an insulating film against which the contacts rest in their inoperative condition. In this case, the thickness of the film and the inner diameter of the ring together with the properties of the leaf spring offer a broad range for selecting the force necessary for closing the switch.

In one embodiment of the invention, the thickness of the film is approximately 15 to 35 $\mu$m. In this case, the displacements of the pin necessary to close the switch are extremely short, and this in turn enables the release device to be made extremely adjustable, as regards trigger slack, first-stage trigger pull and trigger pull.

In one embodiment of the invention, a circuit arrangement for limiting the electric voltage is effective at the mechanical switch. This is advantageous because due to the extremely small distances between the two contacts in the mechanical switch, relatively small voltages as supplied by the, say, 15 volt battery provided for operating the release device could already produce spark-overs in the mechanical switch, unless the voltage is limited at the switch in the manner described above.

The invention is also related to a release device for fire-arms having a trigger which coacts with a lever which is equipped with means for changing the trigger pull, and this release device may—but need not necessarily—be designed in accordance with the above-described features of the invention. The release device just mentioned has been known already from German Laid-Open Patent Application No. 24 04 053. In the known device, the trigger pull is changed by adjusting the initial tension in a spring coupled with the lever. When designed in accordance with the invention, the device offers an enlarged adjustment range for the trigger pull. This results from the fact that the lever ratio can be changed by the user of the fire-arm.

The advantage in this arrangement lies in the fact that the possibilities of adjustment, which consist for instance in means for changing a spring force, are increased by the possibility to change the lever ratio so that the range of adjustment of the trigger pull as a whole can be increased. When changing over from one type of target shooting to another type of target shooting where other trigger pulls are desired or required, it may be absolutely sufficient in some cases to change only the lever ratio and to leave the tension of an existing spring unchanged.

In one embodiment of the invention, the lever has several bores each of which can selectively coact with a bearing pin to form a pivot bearing. The advantage of this arrangement lies in the fact that the user desiring to change the trigger pull is only required to select another bore to coact with the bearing pin. In case the lever is of an essentially straight shape, the row of the bores will in most of the cases always extend in the longitudinal direction of the lever.

In one embodiment of the invention, a part carrying the bearing pin comprises several bores for receiving a bearing pin, and the arrangement of the bores relative to each other is essentially identical to that of the bearing pins relative to each other. In this case, the lever will always occupy the same position within the whole device, irrespective of which one of the bores is engaged by the bearing pin, for whenever another bore in the lever is used to form the pivot bearing, the position of the bearing pin itself is likewise changed.

In many cases, two bores will be sufficient for the lever. But there may also be more than two bores. The bores may be provided in a two-armed lever or else in a one-armed lever.

The present invention is particularly suited for target-shooting, game-shooting and compressed-air fire-arms.

In one embodiment of the invention, several mechanical switches with different trigger pulls are provided which can be selectively inserted into the device. To this end, the mechanical switch may preferably be arranged on a printed circuit with plug connectors for easy insertion into the release device. The advantage of this arrangement lies in the fact that the different trigger pulls can be suitably selected so that when changing over between different types of shooting only the mechanical switch will have to be exchanged and no other changes to the release device, as for instance adjustments of the tension of springs, will be necessary. This permits the shooter to change very quickly from one trigger pull to another, and he will not be required to check and perhaps adjust the trigger pull with the aid of a spring balance. These very favourable properties are in particular achieved by the use of the above-described mechanical switch, because in this case the force required for closing the switch can be kept within very close tolerances by the manufacturer and will exhibit a high degree of recurrence exactitude so that when preset, for instance, to a value of 1.5 daN, the trigger pull can be exactly kept within a tolerance of a few cN.

Figure 2:
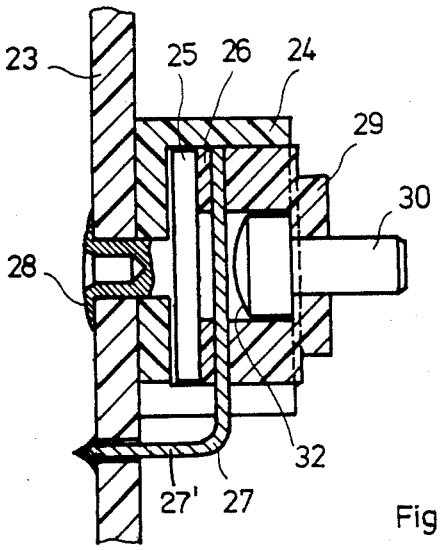
Figure 3:
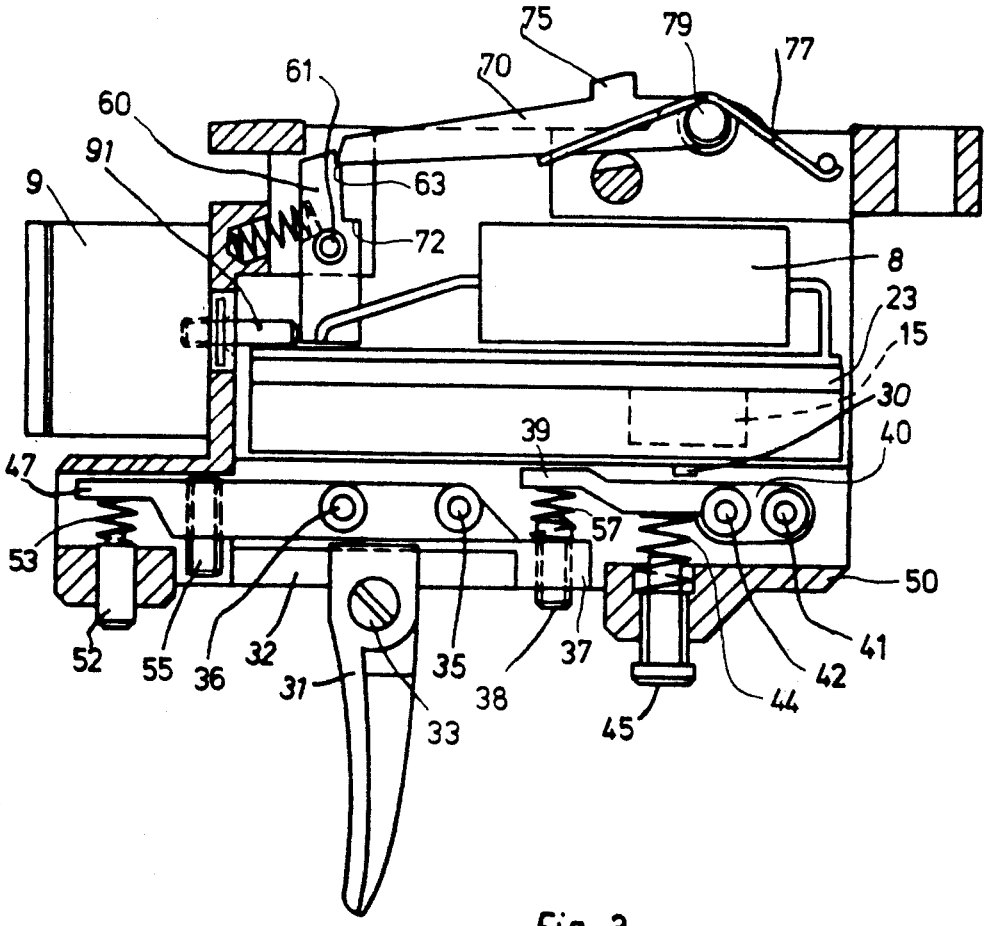

Other advantages of the invention will be apparent from the claims and from the following description of the invention when read in conjunction with the drawing which shows essential details of the invention and in which FIG. 1 shows the electronic circuit of the embodiment, FIG. 2 shows a cross-sectional view of one embodiment of a mechanical switch of the invention and FIG. 3 shows a simplified longitudinal cross-section through the whole release device.

In FIG. 1, the entire electronic circuit is connected via terminals 1, 2 to a voltage source 3 formed by the 15 V battery. The battery can be exchanged as required. Following the terminal 1, a protective diode 4 is provided which serves to protect the semiconductor components of the electronic circuit from being destructed in case the battery 3 should be incorrectly connected by error. The protective diode 4 is followed by a transistor 5 comprising in its base-to-collector circuit a resistor 6 and in its base-to-emitter circuit a capacitor 7. When a shot has been fired, this circuit causes the transistor 5 to be returned to its conductive state only after a certain time lag. In its conductive state, the transistor 5 charges the capacitor 8. The capacitor 8 has connected to it in parallel the winding of an electromagnet 9 and another electronic switch 11 connected in series. The electronic switch 11 takes the form of a controllable semiconductor element, which in the described embodiment consists of a thyristor, so that its current cannot be interrupt by the control electrode. When the capacitor 8 is in the charged condition and the electronic switch 11 is rendered conductive, the capacitor 8 discharges itself via the coil of the electromagnet, and the armature 91 of the electromagnet 9 actuates a trip-releasing catch not shown in FIG. 1. This mechanism will be described later in greater detail in connection with FIG. 3. When the capacitors 8 and 14 (see below) are charged, practically no current at all flows through the transistor 5, the base-to-emitter voltage of the transistor 5 is approx. 0.5 V, and so the transistor is blocked. As soon as the capacitor 8 is discharged, the voltage at the capacitor 7 starts to rise, and at the end of approx. 3 to 10 ms it renders the transistor 5 conductive. A resistor 10 serves to limit the current. This time lag in the return of the transistor 5 to its conductive state ensures that after the capacitor 8 has discharged itself, the other electronic switch 11 is safely returned to its blocked condition and that thereafter the capacitor 8 is re-charged.

Let us suppose that FIG. 1 shows the circuit arrangement in the condition shortly before the firing of a shot. The voltage source 3 charges a capacitor 14 via the winding of the electromagnet 9 and a voltage divider 12, 13. The firing voltage necessary for firing the electronic switch 11 is present at the capacitor 14 only when the capacitor 8 is charged to a voltage sufficient to correctly excite the electromagnetic 9. Let us further assume that a mechanical switch 15 connected in the manner shown in the drawing with the control electrode of the electronic switch 11 and with the voltage divider 12, 13 is closed by the actuation of the trigger which will be described in detail in connection with FIG. 3. When the switch 15 closes, the voltage of the capacitor 14 used for firing is applied to the control electrode of the electronic switch 11 so that the latter assumes its conductive state. At this moment, the capacitor 8 can discharge itself via the electromagnet 9 so that the armature 91 is moved to release the shot. Following the discharge of the capacitor 8, the voltage at the electromagnet 9 drops to zero and further into the negative range. Thus, the electronic switch 11, which takes the form of a thyristor, is in any case blocked. Recharging of the capacitors 8 and 14 for the release of the next shot is possible only after the transistor 5 is again conductive. The firing capacitor 14 requires more time for charging than the capacitor 8. Charging of both capacitors for the release of the next shot takes approximately 2 to 3 s.

The next shot is released by closing the switch 15. A diode 16 arranged in the manner shown in the drawing serves to discharge the capacitor 14 completely when the electronic switch 11 is in the conductive state. This prevents the electronic switch 11 to be returned to its conductive state shortly after the release of a shot, for instance by someone playing with the trigger, because otherwise this could lead on the one hand to the capacitor 8 not being charged and, on the other hand, to the electronic switch 11 remaining constantly in the conductive state, which would cause the battery 3 to be rapidly discharged via the conductive transistor 5.

A resistor 17 limits the current flowing through the diode 16. A resistor 18 serves to maintain the control electrode of the electronic switch 11 at ground potential when the switch 15 is in the inoperative position.

In FIG. 1, a further circuit is shown which can be connected selectively to terminals 1 and 2 and which serves to indicate the condition of the battery. This circuit comprises a switch 19, a resistor 20, a Zener diode 21 and a LED 22, all connected in series. When the switch 19, which may for instance be arranged at the battery housing, is closed, the diode lights up when the voltage in the battery 3 is sufficiently high. Thus, the shooter can verify whether or not the battery must be changed. The electronic circuit as shown in FIG. 1 and the battery 3 are adapted to each other to ensure the least possible consumption of current, i.e. maximally 10 microampere. This means that 15000 to 20000 shots may be released per battery unit. The current consumption of 10 microamperes occurs in the inactive phase of the electronic circuit, i.e. when the capacitor 8 is charged, and does not exceed the normal self-discharging current of the battery. This means that the battery will have to be changed after an extended inactive phase of the electronic circuit only when the battery is discharged as a result of its normal aging process.

Finally it should be noted that the circuit shown in FIG. 1 is completely independent of temperature changes. The values for the firing sequence remain constant within a range of from $-20°$ to $+60°$ C.

The entire electronic circuit shown in FIG. 1 is arranged on a printed wiring board measuring 50 mm by 18 mm. The electronic components are subsequently embedded in a synthetic resin compound to give them sufficient protection against humidity and mechanical influences. Further, this process provides greater mechanical stability of the electronic circuit so that the switching movements of the switch 15 in operation will not have any detrimental effects. The embedded electronic circuit is inserted into the trigger housing like a drawer. The entire trigger housing including the electronic circuit as described in detail in FIG. 3, may be installed in any new and/or existing small arm.

FIG. 3 shows the mechanical switch 15. This switch is mounted on a printed wiring board 23 of the electronic circuit. The switch housing 24 is fastened to the printed wiring board itself by means of a plate-shaped contact disk 25 comprising a bolt-shaped projecting part having its free end passed through the printed wiring board 23 and then beaded over. In the example shown, the disk contact is of circular shape and made from a conductive material, such as brass or a copper, silver or gold alloy. The surface of the disk-shaped contact 25 carries an insulating ring 26 consisting of a plastic film which is maximally 35 micrometers thick. For the manufacture of this insulating ring, the material obtainable on the market under the names of "Tryafol" or "Mylafol" (registered trade marks) may for instance be used. When the diameter of the disk contact 25 is for instance 8 mm, the ring 26 has an inner diameter of approx. 4 to 6 mm and an outer diameter of likewise 8 mm. The variation of the inner diameter influences the trigger pull for the shot. Arranged at the side of the insulating ring 26 facing away from the disk contact 25 is a leaf spring 27 which forms the other contact of the mechanical switch 15. The said leaf spring has essentially the shape of a circular disk with 8 mm diameter and comprises a connection lug 27' which projects outwardly through a slot in the housing 24 and is soldered to a series of conductors in the printed wiring board 23.

The leaf spring 27 consists of a material having a high coefficient of elasticity, such as spring-hard tin bronze. In the example shown, it is 0.1 mm thick. A housing cover 29 inserted into the housing 24 has one annular surface in contact with the leaf spring 27 and clamps the insulating ring 26 between the contact disk 25 and the leaf spring 27. A pin 30 is guided to slide in the axial direction of the switch 15 in the housing cover 29. A portion of the said pin projects through the housing cover 29, whereas another portion of greater diameter is positioned within the housing cover 29, so that it is captatively fastened to the switch 15. The freely projecting end of the pin 30 is actuated by a transmission jack 40. The other end of the pin 30 is provided with a convex face 32 having a radius of approx. 4 mm. Now, when the pin 30 is displaced towards the leaf spring 27 by the operation of the trigger, the convex surface 32 contacts the leaf spring 27 at one point, bending the latter in the direction of the surface of the contact disk 25, as the pin is further moved. When the leaf spring 27 and the contact disk 25 get into contact, the switch 15 is closed and the shot is released, as described already in connection with FIG. 1. The surface 32 may also have another radius. The relation between this radius and the diameter of the opening of the insulating ring 26 should be selected to ensure that the radius of the convex surface 32 is smaller than that of the curvature of the leaf spring 27 when bent in the direction of the surface of the contact disk 25. The pin 30 consists conveniently of an electrically insulating, non-resilient material. In FIG. 2, the ring 26 and the leaf spring 27 have been shown excessively thick, for better clarity.

FIG. 3 shows a cross-section through the entire device. A trigger tongue 31 which when the shooter operates the release device is moved to the right, as viewed in FIG. 3, is mounted on a trigger bar 32 by means of a set screw 33. After untightening the said set screw 33, the trigger tongue 31 can be displaced along the bar to adapt the trigger tongue to the length and the tip of the shooter's finger. The trigger bar 32 comprises two bores 35 and 36 provided in horizontally spaced arrangement, as viewed in FIG. 3. All parts of the release device are mounted in a housing 50. The housing 50 is provided with bores not shown in FIG. 3 and situated behind the bores 35 and 36. These bores serve to selectively accommodate a bearing pin—likewise not shown—for the trigger bar 32, so that the trigger bar 32 can swing about the pivot bearing formed either by the bore 35 and the bearing pin or by the bore 36 and the bearing pin. This change of the position of the bearing pin can be effected by the shooter and serves to select a different trigger pull range. The trigger bar 32 projects in both directions beyond the bores 35 and 36, thus forming a two-armed lever. When in the view shown in FIG. 3, the trigger tongue 31 is operated, the right-hand end portion 37 of the trigger bar 32 moves upwardly, and the upper end of a screw 38 inserted into the end portion 37 and forming a movable stop acts from below against a transmission jack 40 taking the form of a one-armed lever and acting with its center portion upon the pin 30 of the switch 15. The right-hand end portion of the transmission jack 40 comprises two laterally spaced bores 41 and 42 which similarly to the arrangement described in connection with the trigger bar 32 coacts with a bearing pin which can be inserted by the shooter in one of two bores provided in the housing 50, in line with the said bores 41 and 42, so as to form a pivot bearing for the transmission jack 40. The purpose of this arrangement is that different transmission ratios, i.e. ratios between the efficient lever lengths between the pivot bearing and the free end 39 and between the pivot bearing and the pin 30 are obtained depending on which one of the bores 41 and 42 is used for inserting the bearing pin. A pressure spring 44 the tension of which can be adjusted by means of an adjusting screw 45, acts upon the bottom face of the center portion of the transmission jack 40. The force exerted by the spring 44 via the transmission jack 40 on the pin 30 produces an initial loading of the pin 30 and, as a result, of the leaf spring arranged in the switch 15, thus reducing the additional force to be applied via the trigger tongue 31 for closing the switch 15.

A set screw 52 arranged in the housing 50 in the area of the left end portion 47 of the trigger bar 32—as viewed in the drawing—serves to adjust the pretension of a pressure spring 53 acting upon the bottom face of the said end portion 47. The force of the spring 53 determines the first-stage trigger pull when a trigger slack has been adjusted, i.e. when in the inoperative position of the whole arrangement a distance exists between the free end of the screw 38 and the end 39 of the transmission jack 40. When no such distance exists, i.e. when the trigger device is set to direct trigger action, the force of the spring merely increases the trigger pull as such. In this latter case, only a very small movement of the trigger tongue 31 will be required for releasing the shot. Nevertheless, the trigger pull necessary for releasing a shot in the case of direct trigger action can be varied within wide limits, for instance between a few cN and 1.5 daN.

A set screw 55 screwed into the trigger bar near its foremost end 47 and the upper end of which rests against a portion of the housing 50, also serves to adjust the trigger slack. Thus, the two screws 38 and 55 permit the adjustment of the trigger slack and the rotational position of the trigger bar 32 in the inoperative position of the trigger device.

It may be convenient to provide another pressure spring 57 between the end 37 of the trigger bar 32 and the end 39 of the transmission jack 40, in addition to the springs shown in FIG. 3. Contrary to the pressure spring 44 likewise acting upon the transmission jack 40, this pressure spring would however not reduce the trigger pull and also, contrary to the pressure spring 53, not increase the trigger pull as such. In other embodiments of the invention, the spring 53 may be suppressed when the spring 57 is present. When the screw 52 is moved upwardly right to the stop, the pivoting motion of the trigger bar 32 is blocked, which means that the whole release mechanism is blocked, for instance for transport purposes or to secure the arm against unauthorized use.

In FIG. 3, the electronic circuit, of which only the printed wiring board 23, the capacitor 8 and the mechanical switch 15 are shown, has been inserted in the form of a drawer, but in a manner not shown in detail, into the trigger housing 50. The capacitor 8 is situated above the printed wiring board 23, and the mechanical switch 15 below the latter. In the embodiment shown in FIG. 3, the electromagnet 9 is connected to the electronic circuit by means of a plug connection not shown in detail. When the electromagnet 9 is excited, the armature 91 is moved towards the right, as viewed in FIG. 3, and acts against the lower end of a release jack 60 which pivots about a pivot axis 61 to release a retaining lever 70 resting against a shoulder 63 in the release jack 60. The left end of the retaining lever 70, as viewed in FIG. 3, moves downwardly until it comes to rest against a lower shoulder 72 in the release jack 60, whereby a lug 75 is lowered to release the shooting action as such. During the loading action for the next shot, a spring 77 swings the retaining lever 70 back about its pivot axis 79 into its initial position. Thereafter, the whole mechanism shown in FIG. 3 is again in its initial position.

The system shown in FIG. 3 is suitable for all types of small arms in the target shooting, game shooting, compressed-air and cross-bow sectors. It goes without saying that the mechanical portion of the whole system must be adapted to the dimensions of the individual arm. The system is suited for new arms, but can be installed also without any difficulties into existing arms. Where a mechanical safety is required, this should be conveniently adapted to the individual arm.

Maintenance and care of the release device described above are very simple. In case of a defect, the electronic circuit can be exchanged by any layman. The exchange of the electromagnet is also easy and simple because in the embodiment shown in FIG. 3, it is connected to the electronic circuit as such by means of a plug connection. In the mechanical part, the layman can also adjust the trigger pulls to a value of 1.5 daN. The shooter can carry out all the necessary adjustments himself, using a simple, commercial screw driver, and does not need specialist help. On request, even higher trigger pulls than those mentioned above can be obtained. To this end, it is necessary either to provide a different insulating ring in the mechanical switch and/or to give the surface 32 of the pin 30 a different shape. The use of the electronic circuit keeps the wear of the surfaces of those parts of the trigger device which get into mechanical contact with each other very small. This reduces the demands that have to be placed upon the surface processing of the parts in question, and allows a certain reduction of the manufacturing cost, without imparing the operational safety.

In the embodiment shown, the plastic film ring 26 has a thickness of 35 μm in the unloaded state. Under load, the film is somewhat compressed, for instance to a thickness of 15 μm.

In the circuit arrangement shown in FIG. 1, the resistor 12 has a resistance of 6.8 MΩ and the resistor 13 has a resistance of 2.7 MΩ. The capacitor 8 is an electrolytic capacitor of 470 μF, with a leakage current of 0.5 μA.

The voltage divider 12, 13 reduces the voltage applied to the mechanical switch 15 when a new battery 3 is used to a maximum of 4.7 volts—allowing for certain tolerances—so that spark-overs are safely avoided. When the battery is almost discharged, the voltage applied to the switch 15 is still approx. 1.7 volts, and this voltage is still sufficient to render the thyristor 11 conductive. The current flowing through the voltage divider 12, 13 reaches a maximum value of approx. 1.5 μA. The force required for closing the mechanical switch 15 at the pin 30 ranges conveniently somewhere between 200 and 900 cN, depending on the design of the switch 15.

A limitation of the current by the resistor 10 to approx. 20 to 30 mA may lead to an efficient utilization of the battery capacity. If desired, a smaller resistor 10 may be used to obtain quicker charging of the capacitor 8.

What we claim is:

1. An electronic release device for a fire arm, comprising an electromagnet adapted to cause firing of said fire arm, a first capacitor connected across said electromagnet, a source of current for charging said first capacitor and an electronic switch arranged between said capacitor and electromagnet and means for firing said electronic switch to cause discharge of said first capacitor through said electromagnet comprising a trigger manipulated mechanical switch having one terminal connected to the control electrode of said electronic switch, a second capacitor connected in parallel across said electronic switch to be charged on passage of current through said electromagnet, said second capacitor having one terminal connected to the other terminal of said mechanical switch for discharge of current therethrough, and a voltage divider for delaying the charging of said second capacitor for a time greater then the charging time of said first capacitor whereby firing of said electronic switch is possible only after said first capacitor has reached a predetermined charge.

2. The device according to claim 1, in which the voltage divider is connected in parallel to the electronic switch.

3. The device according to claim 2, wherein a diode is connected between the other terminal of the mechanical switch and the connection between the electronic switch and the electromagnet.

4. The device according to claim 1, wherein the mechanical switch comprises a first and a second contact, the latter taking the form of a leaf spring and which contacts in the inoperative state are arranged closely adjacent each other, said trigger having coupled thereto a pin adapted to be pressed against the side of the leaf spring facing away from the said first contact and wherein the side of the leaf spring facing the said first contact is supported by insulating material spaced at a certain distance from the area of impact of the said pin.

5. The device according to claim 4, wherein a ring made from an insulating film is provided between the said first and the said second contacts and that in the inoperative position the two contacts rest against such ring.

6. The device in accordance with claim 5, wherein the film has a thickness of approx. 15 to 35 μm.

7. The device according to claim 5, wherein the voltage divider is provided for limiting the electric voltage effective at the mechanical switch.

8. The device in accordance with claim 1, including several mechanical switches each having different trigger pulls are provided that can be selectively inserted into the device.

* * * * *

UNITED STATES PATENT AND TRADEMARK OFFICE

CERTIFICATE OF CORRECTION

PATENT NO. : 4,347,679

DATED : September 7, 1982

INVENTOR(S) : Kurt GRUNIG ET AL

It is certified that error appears in the above-identified patent and that said Letters Patent are hereby corrected as shown below:

On the cover sheet [73] the name of the assignee should read -- FEINWERKBAU, WESTINGER & ALTENBURGER GmbH & Co., Oberndorf, Fed. Rep. of Germany--.

Signed and Sealed this

*Third* Day of *May 1983*

[SEAL]

*Attest:*

GERALD J. MOSSINGHOFF

*Attesting Officer*

*Commissioner of Patents and Trademarks*